US006497216B2

(12) United States Patent
Gaessler et al.

(10) Patent No.: US 6,497,216 B2
(45) Date of Patent: Dec. 24, 2002

(54) PUMP FOR SUPPLYING A FUEL INJECTION SYSTEM AND FOR SUPPLYING A HYDRAULIC VALVE CONTROLLER FOR INTERNAL COMBUSTION ENGINES

(75) Inventors: Hermann Gaessler, Vaihingen (DE); Udo Diehl, Stuttgart (DE); Karsten Mischker, Leonberg (DE); Rainer Walter, Pleidelsheim (AT); Bernd Rosenau, Tamm (DE); Juergen Schiemann, Markgroeningen (DE); Christian Grosse, Kornwestheim (DE); Georg Mallebrein, Korntal-Muenchingen (DE); Volker Beuche, Stuttgart (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/796,630

(22) Filed: Mar. 2, 2001

(65) Prior Publication Data

US 2001/0022171 A1 Sep. 20, 2001

(30) Foreign Application Priority Data

Mar. 6, 2000 (DE) ..... 100 10 945

(51) Int. Cl.[7] ..... F02M 41/00

(52) U.S. Cl. ..... 123/450; 123/90.12

(58) Field of Search ..... 123/446, 449, 123/450, 90.12; 417/273, 269, 429, 470, 521; 92/72

(56) References Cited

U.S. PATENT DOCUMENTS

| | | | | |
|---|---|---|---|---|
| 4,884,545 A | * | 12/1989 | Mathis | 123/447 |
| 5,511,956 A | * | 4/1996 | Hasegawa et al. | 417/271 |
| 6,109,894 A | * | 8/2000 | Chatelain | 417/429 |
| 6,162,022 A | * | 12/2000 | Anderson et al. | 417/213 |
| 6,240,901 B1 | * | 6/2001 | Jay | 123/446 |

FOREIGN PATENT DOCUMENTS

FR WO 96/14496 * 5/1996

* cited by examiner

*Primary Examiner*—Willis R. Wolfe
*Assistant Examiner*—Mahmoud Gimie
(74) *Attorney, Agent, or Firm*—Ronald E. Greigg

(57) ABSTRACT

A fuel injection pump for internal combustion engines having at least one additional pump element for feeding fluid from a low-pressure side to a high-pressure side. With this fluid, a hydraulic valve controller of the engine can be driven.

11 Claims, 2 Drawing Sheets

Fig. 2
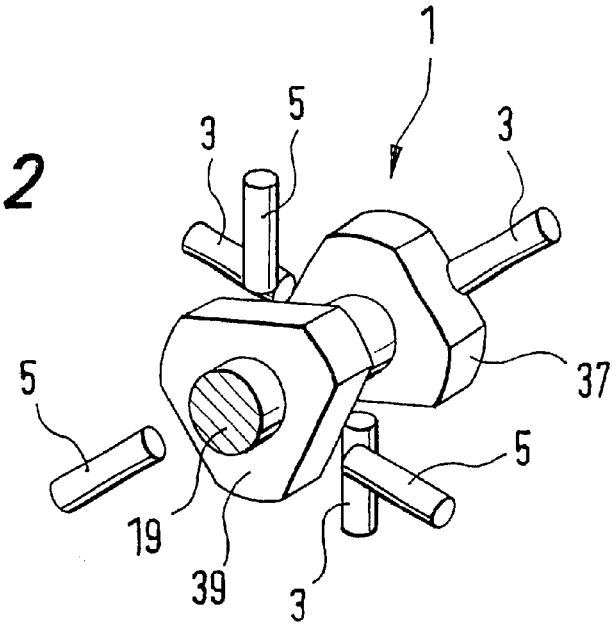
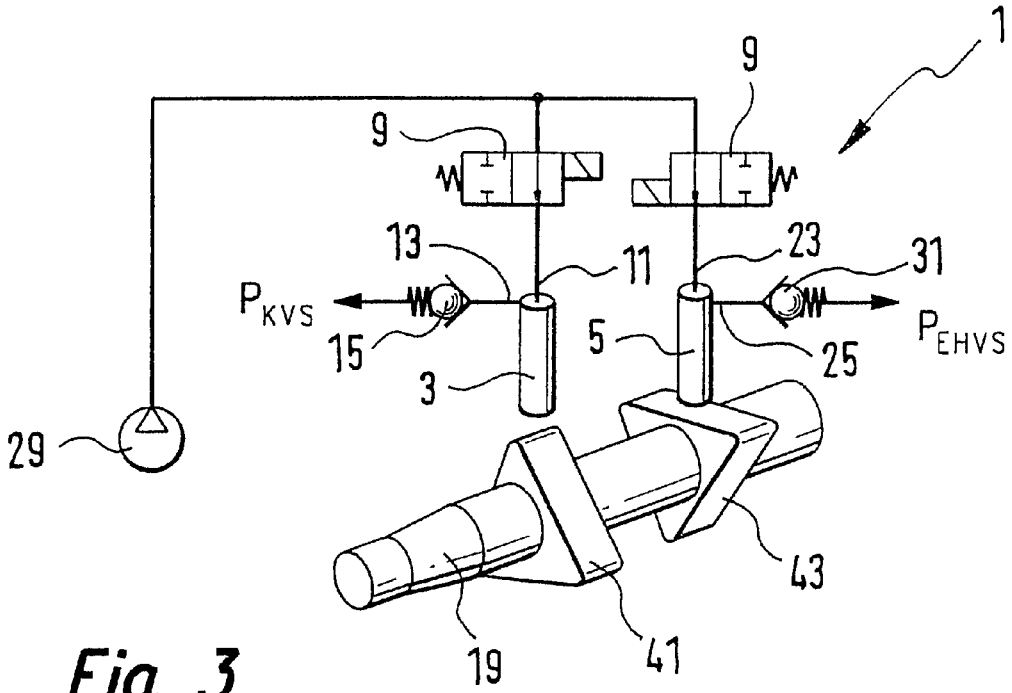
Fig. 3

PUMP FOR SUPPLYING A FUEL INJECTION SYSTEM AND FOR SUPPLYING A HYDRAULIC VALVE CONTROLLER FOR INTERNAL COMBUSTION ENGINES

BACKGROUND OF THE INVENTION

FIELD OF THE INVENTION

The invention is directed to a pump for supplying a fuel injection system and a hydraulic valve controller for internal combustion engines, having a first low-pressure side, having a first high-pressure side, and having means for feeding fuel from the low-pressure side to the high-pressure side.

DESCRIPTION OF THE PRIOR ART

Pumps of the type with which this invention is concerned are known in the most various embodiments as fuel injection pumps for internal combustion engines. On their low-pressure side, they communicate with a fuel supply tank, and with their high-pressure side, they feed for instance into the high-pressure fuel reservoir of a common rail fuel injection system or into the injection nozzles of the engine. Fuel injection systems in which a pressure step-up means is disposed between the injection pump and the injector or the injection nozzle are also known.

With ever more stringent demands made in terms of the exhaust gas limit values and fuel consumption of internal combustion engines, a promising approach to achieving these sometimes contrary demands is to control the valves hydraulically, preferably electrohydraulically.

OBJECT AND SUMMARY OF THE INVENTION

The object of the invention is to furnish a pump which provides the supply both of fuel to a fuel injection pump and of a hydraulic fluid, hereinafter simply called fluid, to a hydraulic valve controller.

According to the invention, this object is attained by a pump for supplying a fuel injection system and for supplying a hydraulic valve controller for internal combustion engines, having a first low-pressure side, having a first high-pressure side, and having means for feeding fuel from the first low-pressure side to the first high-pressure side, in which a second low-pressure side, a second high-pressure side, and means for feeding a fluid from the second low-pressure side to the second high-pressure side are present.

This pump according to the invention has the advantage that a second pump for supplying fluid to a hydraulic valve controller can be omitted. This produces considerable cost savings, reduces the installation space required, simplifies sealing from the environment, and finally improves the efficiency of the engine, since only one pump has to be driven. Because of the presence of means for feeding fuel to a first high-pressure side and means for feeding a fluid to a second high-pressure side, it is equally possible to provide different pressure levels for supplying the fuel injection system and for supplying the hydraulic valve controller. By using a fluid adapted especially to the demands of the hydraulic valve controller, its operating performance can be improved further.

Variants of the invention provide that the means for feeding fuel from the first low-pressure side to the first high-pressure side and the means for feeding a fluid from the second low-pressure side to the second high-pressure side have at least one pump element, so that the advantages of the pump elements, known from the prior art, in fuel injection pumps can also be made use for the pump of the invention.

In a further feature of the invention, it is provided that the pump has a drive shaft that at least indirectly actuates the means for feeding fuel and the means for feeding a fluid, so that the coupling of the pump to the engine is effected in a simple, reliable way.

In another feature of the invention, the means for feeding fuel and/or the means for feeding a fluid are disposed radially to the longitudinal axis of the drive shaft, so that the advantages of the radial disposition, known from the prior art, of the means for feeding fuel also come into play in the pump according to the invention. Especially, when the drive shaft is an eccentric shaft, a deflection of the motion of the eccentric element or elements of the drive shaft can be omitted.

In a further variant of the invention, it is provided that the means for feeding fuel and the means for feeding a fluid each have at least two pump elements, disposed radially to the longitudinal axis of the drive shaft and opposite one another, so that the drive shaft is free of forces that engage crosswise to the longitudinal axis of the drive shaft. This avoids bending stress in the drive shaft and correspondingly reduces the bearing forces.

In a further feature of the invention, the pump element or pump elements disposed radially to the longitudinal axis of the drive shaft and opposite one another of the means for feeding fuel and the means for feeding a fluid are distributed uniformly over the circumference of the drive shaft, so that the torque to be transmitted from the engine to the pump drive shaft is made more uniform, and thus the torsional load on the drive shaft is also reduced.

In a further feature of the invention, the means for feeding fuel and the means for feeding a fluid are spaced apart from one another in the direction of the longitudinal axis of the drive shaft, so that a larger number of pump elements can be provided, which can be significant especially in engines with many cylinders. The spatial separation of the means for feeding fuel from the means for feeding a fluid also leads to simplifications in the hydraulic communication of the first and second low-pressure side with the first and second high-pressure side.

Further features of the invention provide that the pump is a radial piston pump or an in-line pump, so that the advantages, known from the prior art, of these types of pump also come into play in the pump of the invention.

In a further feature of the invention, it is provided that the quantity regulation of the means for feeding fuel and/or of the means for feeding a fluid is effected by means of an intake throttle on the first low-pressure side or the second low-pressure side, so that the pump of the invention also operates with good efficiency in the partial-load range.

In another variant of the invention, it is provided that the quantity regulation of the means for feeding fuel or of the means for feeding a fluid is effected by means of a recirculation valve on the first high-pressure side or the second high-pressure side, so that effective quantity regulation can be attained in a simple way.

In a further feature of the invention, the means for feeding a fluid feed fuel, so that the number of fuels is reduced, and furthermore internal leakage between the means for feeding fuel and the means for feeding a fluid cause insignificant impairment, if any, to the operation of the engine.

In a further feature, it is provided that the first low-pressure side and the second low-pressure side have the same fuel supply, so that only one low-pressure pump, connected upstream of the pump of the invention, is required, and the engineering expense is reduced.

In further features of the invention, the first high-pressure side communicates hydraulically with a high-pressure fuel reservoir or an injection nozzle and the second high-pressure side communicates hydraulically with a hydraulic valve controller, preferably an electrohydraulic valve controller, so that the pump of the invention can be integrated with an engine that has a fuel injection system and a hydraulic valve controller.

BRIEF DESCRIPTION OF THE DRAWING

The invention will be better understood and further objects and advantages thereof will become more apparent from the ensuing detailed description of preferred embodiments taken in conjunction with the drawings, in which:

FIG. 2 schematically shows a second embodiment of a pump according to the invention, with a radial disposition of the pump elements; and FIG. 3 schematically shows a third exemplary embodiment of a pump according to the invention, of the in-line type.

DESCRIPTION OF THE PREFERRED EMBODIMENTS

Figure 1:
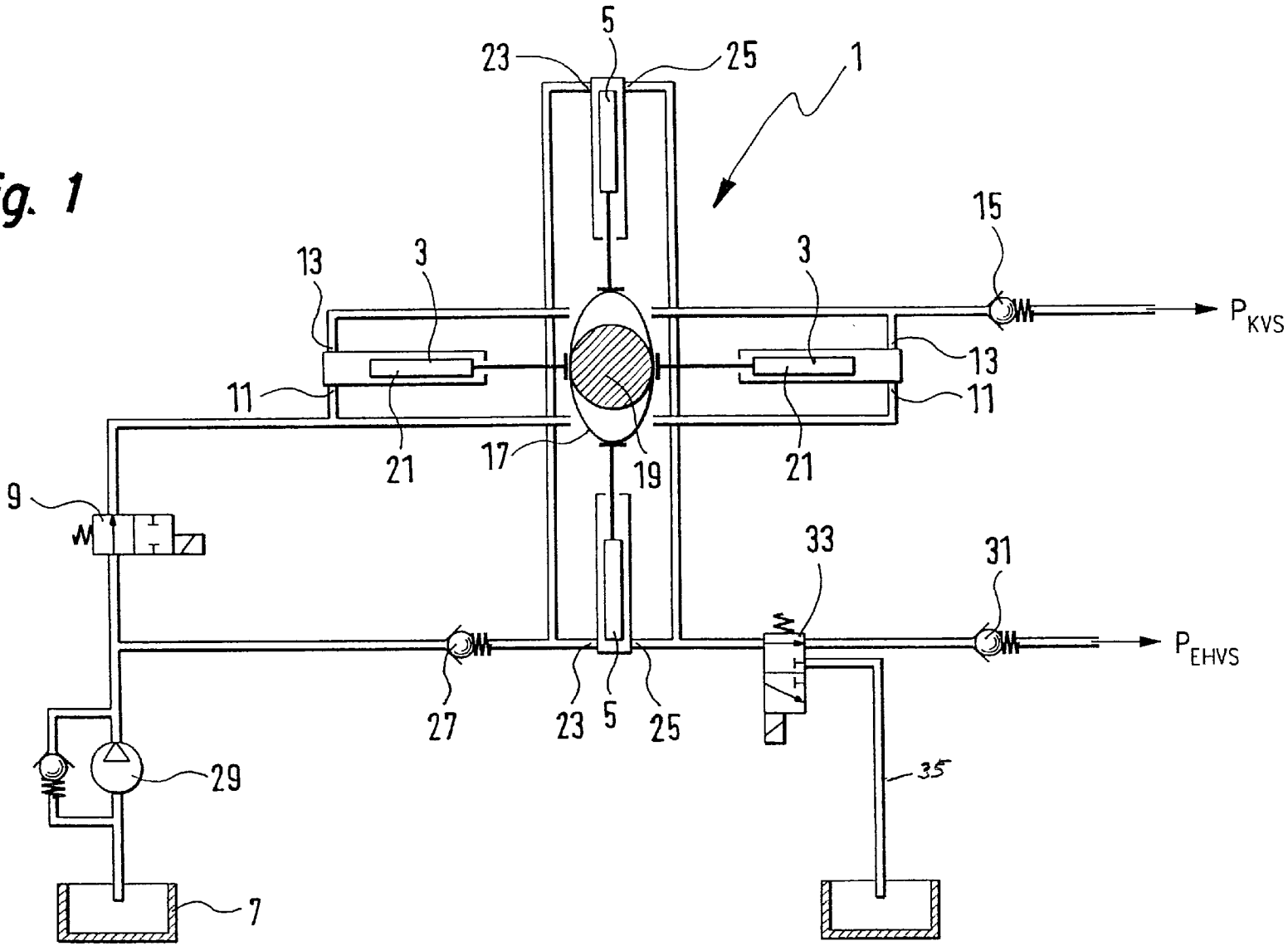
FIG. 1 schematically shows a first embodiment of a pump according to the invention.

In FIG. 1, a first exemplary embodiment of a pump 1 according to the invention is shown. The pump 1 has two pairs of pump elements 3 and 5. The pump elements 3 feed fuel from a fuel tank 7 via a controllable intake throttle 9 into a fuel supply system (KVS), not shown, of the internal combustion engine, also not shown. The pump elements 3 and/or 5 can be pump elements, known from the prior art, that have pump pistons.

A first low-pressure side 11 of the pump elements 3 communicates hydraulically with the fuel tank 7. A first high-pressure side 13 of the pump elements 3 communicates hydraulically with the fuel supply system, not shown. The pressure $P_{KVS}$ is applied to the first high-pressure side 13. Between the pump 1 and the fuel injection system, not shown, there is a first check valve 15, which prevents the reverse flow out of the fuel supply system to the pump 1.

The pump elements 3 are actuated via a double cam 17 of a drive shaft 19 of the pump 1. In the position shown for the double cam 17, the pump elements 13 are at the beginning of their supply stroke. As soon as the drive shaft 19 is rotating, the double cam 17 moves the piston 21 of the pump element 3 outward and thus feeds fuel to the first high-pressure side 13. The prerequisite for this, however, is that a reverse flow of fuel out of the pump elements 3 into the fuel tank 7 is avoided. This can be accomplished by means of a check valve, not shown, or by the controllable intake throttle 9, which is closed when fuel feeding through the pump elements 3 is desired. The requisite supply quantity and displacement of the pump elements depend on the rpm, the required pressure level in the fuel supply system, and the fuel consumption of the engine.

Pump elements 5 are offset by 90° from the pump elements 3 and supply a fluid to the hydraulic valve controller, not shown, in particular an electrohydraulic valve controller (EHVS). In the exemplary embodiment shown in FIG. 1, the fluid of the electrohydraulic valve controller is again fuel. The pump elements 5 on their second low-pressure side 23 therefore likewise aspirate fuel from the fuel tank 7 and feed it, via their second high-pressure side, to the electrohydraulic valve controller, not shown, at the pressure $P_{EHVS}$. To prevent a return flow of fuel from the pump elements 5 into the fuel tank 7, a second check valve 27 is provided.

To assure the supply of fuel to the pump elements 3 and 5 under all operating conditions, a low-pressure pump 29 is provided between the pump 1 and the fuel tank 7. To prevent a return flow of the fuel from the electrohydraulic valve controller into the pump elements 5, a third check valve 31 is provided. The quantity regulation of the pump elements 5 is effected via a controllable recirculation valve 33, which depending on its switching position connects the pump elements 5 to either the electrohydraulic valve controller or a fuel return 35.

Because the pump elements 3 and 5 are at an angle of 90° from one another, the drive shaft 19 is stressed relatively uniformly during a revolution. A further evening out or stabilizing of the stress can be effected if for instance three or more pump elements each, instead of two pump elements 3 and two pump elements 5, are disposed uniformly around the drive shaft 19. By connecting the pump elements 3 in parallel and by connecting the pump elements 5 in parallel, it is assured that only insignificant radial forces, if any, are exerted on the drive shaft 19 by the pump elements 3 and 5.

In FIG. 2, a further embodiment of a pump 1 according to the invention is shown, highly simplified. The drive shaft 19 has two eccentric portions, which act, each via a respective eccentric ring 37 and 39, on the pump elements 3 and 5 in a manner not shown. The eccentric rings 37 and 39 do not rotate jointly with the drive shaft 19. As a result, the force transmission between the drive shaft 19 and the piston, not shown, of the pump elements 3 and 5 is improved. In the second exemplary embodiment, three pump elements 3 and 5 each are present. The pump elements 3 and 5 are each disposed radially to the longitudinal axis of the drive shaft 19; however, they are spaced apart from one another in the direction of the longitudinal axis of the drive shaft 19. As a result, it is possible for more pump elements 3 or 5 to be disposed around the drive shaft 19. Also because of the spatial separation of the pump elements 3 and 5, better sealing and simpler guidance of the fuel or fluid in the pump 1 are attainable. Finally, the stroke of the pump elements 3 and of the pump elements 5 can be selected differently, by selecting different eccentricity for the eccentric portions of the drive shaft 19. This can be advantageous if the supply quantities and/or the pressure level of the fuel supply system and of the electrohydraulic valve controller deviate markedly from one another. However, it is also possible with the same stroke of the pump elements 3 and 5 to attain different pressure levels on the first high-pressure side of the pump elements 3 and the second high-pressure side of the pump elements 5. The communication of the pump elements 3 and 5 with a fuel tank, not shown, and with the fuel supply system or electrohydraulic valve controller is not shown in FIG. 2.

In FIG. 3, a third exemplary embodiment of a pump 1 according to the invention is shown, highly simplified. One pump element 3 and one pump element 5 are spaced apart from one another in the direction of the longitudinal axis of the drive shaft 19. Their first low-pressure side 11 and their first low-pressure side 23 communicate with a fuel tank, not shown, via intake throttles 9 and a low-pressure pump 29. The first high-pressure side 13 of the pump element 3 feeds fuel into the fuel supply system, not shown. The second high-pressure side 25 of the pump element 5 feeds fuel into the electrohydraulic valve controller, which is also not shown. The drive shaft 19 has a first cam 41 with three lobes and a second cam 43, also with three lobes. The lobes of the first cam 41 and of the second cam 43 are rotated by 90° from one another, thus making the drive moment of the drive shaft 19 more uniform. Because the first cam 41 and the second cam 43 each have three lobes, the pump elements 3 and 5 each execute three pumping strokes per revolution of the drive shaft 19. It is understood that further pump elements 3 and 5, not shown, can be disposed in line with one another, each driven by a cam, also not shown, of the drive shaft 19. As a result, the advantages of an in-line design are rendered usable for the pump of the invention as well.

Embodiments of a pump according to the invention in the form of an axial piston or in-line pump are also possible. In these designs, the torsional moment acting on the drive shaft is made more uniform by an offset, corresponding to the crankshaft of the engine, of the cams of the drive shaft in the direction of rotation.

The foregoing relates to preferred exemplary embodiments of the invention, it being understood that other variants and embodiments thereof are possible within the spirit and scope of the invention.

We claim:

1. A pump for supplying a fuel injection system and for supplying a hydraulic valve controller for internal combustion engines, comprising a first low-pressure side (11), a first high-pressure side (13), and means (3) for feeding fuel from the first low-pressure side (11) to the first high-pressure side (13), and a second low-pressure side (23), a second high-pressure side (25), and means (5) for feeding fluid from the second low-pressure side (23) to the second high-pressure side (25), wherein the pump (1) comprises a drive shaft (19) that at least indirectly actuates the means (3) for feeding fuel and the means (5) for feeding fluid and the means (3) for feeding fuel and the means (5) for feeding fluid each have at least two pump elements (3, 5), disposed radially to the longitudinal axis of the drive shaft (19) and opposite one another.

2. The pump according to claim 1, wherein the pump elements (3, 5) of the means for feeding fuel and the means for feeding fluid are distributed uniformly over the circumference of the drive shaft.

3. The pump according to claim 1, wherein the means (3) for feeding fuel and the means (5) for feeding fluid are spaced apart from one another in the direction of the longitudinal axis of the drive shaft (19).

4. The pump according to claim 1, wherein the pump (1) is a radial piston pump.

5. The pump according to claim 1, wherein the pump (1) is an axial piston pump or in-line pump.

6. The pump according to claim 1, wherein a quantity regulation of the means (3) for feeding fuel and/or of the means (5) for feeding fluid is effected by means of an intake throttle (9) on the first low-pressure side (11) or the second low-pressure side (23).

7. The pump according to claim 1, wherein a quantity regulation of the means (3) for feeding fuel and/or of the means (5) for feeding fluid is effected by means of a recirculation valve (33) on the first high-pressure side (13) and/or the second high-pressure side (25).

8. The pump according to claim 1, wherein the means (5) for feeding fluid feeds fuel.

9. The pump according to claim 8, wherein the first low-pressure side (11) and the second low-pressure side (23) have the same fuel supply (7).

10. The pump according to claim 1, wherein the first high-pressure side (13) communicates hydraulically with a high-pressure fuel reservoir or an injection nozzle.

11. The pump according to claim 1, wherein the second high-pressure side (25) communicates hydraulically with a hydraulic valve controller.

* * * * *